US006824442B2

(12) United States Patent
Andrews et al.

(10) Patent No.: US 6,824,442 B2
(45) Date of Patent: Nov. 30, 2004

(54) WEAPON FIRING TOY FIGURE RESPONSIVE TO WRIST CONTROLLER

(75) Inventors: Michael Andrews, Los Angeles, CA (US); Alton Takeyasu, Playa Del Rey, CA (US); Eric Ostendorff, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/782,537

(22) Filed: Feb. 12, 2001

(65) Prior Publication Data

US 2003/0220044 A1 Nov. 27, 2003

(51) Int. Cl.[7] ..... A63H 30/00
(52) U.S. Cl. ..... 446/405; 446/175; 446/473
(58) Field of Search ..... 446/175, 268, 446/297–298, 330, 355, 397–401, 404–405, 454, 456, 473; D21/567, 576, 585; 463/39, 49, 51–57

(56) References Cited

U.S. PATENT DOCUMENTS

| | | | | |
|---|---|---|---|---|
| 3,675,925 A | | 7/1972 | Ryan et al. | |
| 4,571,201 A | | 2/1986 | Matsuda | |
| 4,575,352 A | | 3/1986 | Matsuda | |
| 4,583,958 A | | 4/1986 | Matsuda | |
| 4,623,317 A | | 11/1986 | Nagano | |
| 4,696,654 A | * | 9/1987 | Welch et al. | 446/268 |
| 4,815,733 A | | 3/1989 | Yokoi | |
| 5,127,658 A | | 7/1992 | Openiano | |
| 5,142,803 A | | 9/1992 | Lang | |
| 5,158,492 A | | 10/1992 | Rudell et al. | |
| 5,158,493 A | | 10/1992 | Morgrey | |
| 5,261,852 A | | 11/1993 | Ejima | |
| 5,299,971 A | | 4/1994 | Hart | |
| 5,741,185 A | | 4/1998 | Kwan et al. | |
| 6,071,166 A | * | 6/2000 | Lebensfeld et al. | 446/175 |

* cited by examiner

*Primary Examiner*—Mark Sager
(74) *Attorney, Agent, or Firm*—Roy A. Ekstrand

(57) ABSTRACT

A toy figure includes a lower torso and supporting legs together with a supplemental angled support. An upper torso and weapons backpack joined thereto is pivotally supported upon the lower torso and is pivoted in response to activation of a bi-directional motor and gear drive mechanism. The backpack supports a plurality of projectile launchers and simulated machine gun units which are pivotally moveable between a stored or closed configuration and a forwardly directed launch or firing configuration. A second motor operated within the upper torso rotates a plurality of cam which in turn engage various latch mechanisms for release of the spring-driven projectile launchers to fully deploy the weapons in their firing positions and to initiate projectile launch. A pair of infrared sensors within the weapons backpack respond to commands received from a remote controller worn on the user's wrist.

7 Claims, 9 Drawing Sheets

36
37
35
33
34
17
39
51
52
55
40
46
56
53
116
45
54
50
44
111
115
65
30
67
60
62
92
110
112
16
93
90

37
33
35
36
34
17
39
56
51
52
55
54
46
53
30
50
43
40
116
45
115
67
65
114
16
110
112
90
92
60
93
62

FIG. 13
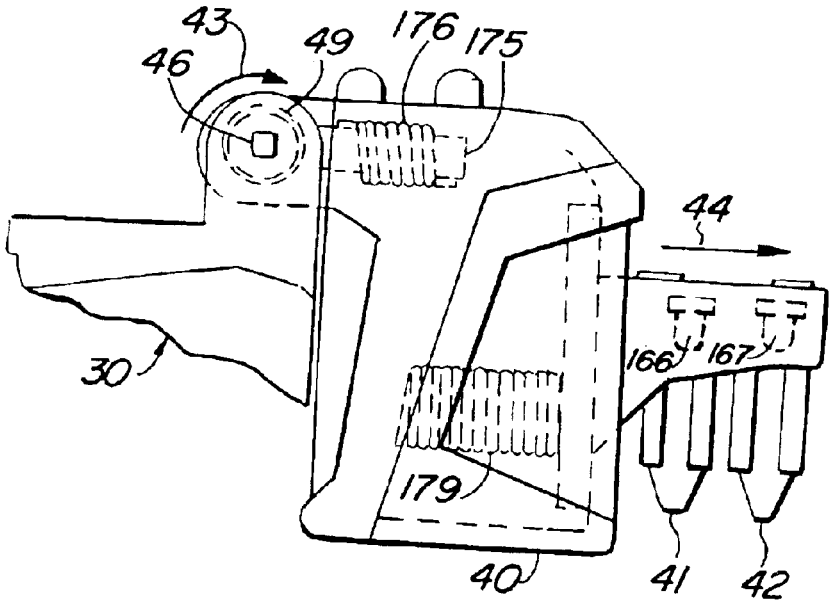
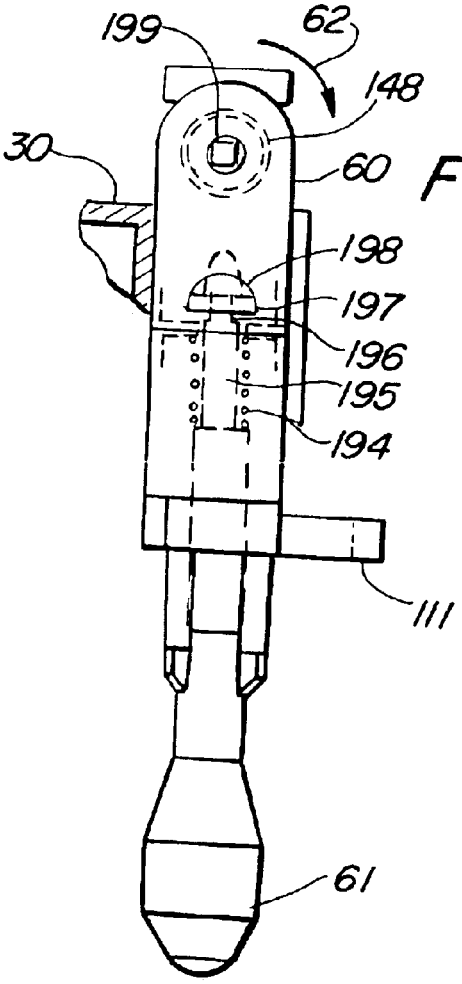
FIG. 14

WEAPON FIRING TOY FIGURE RESPONSIVE TO WRIST CONTROLLER

FIELD OF THE INVENTION

This invention relates generally to toy figures and particularly to those operating under a remote control apparatus.

BACKGROUND OF THE INVENTION

Toy figures have proven to be an extremely popular and long-lasting toy category which practitioners in the toy arts have pursued vigorously for many years. Such toy figures are well known and vary substantially from simple plastic often articulated dolls or toy figures to more complex structures which utilize internal battery-powered electric motor apparatus for movement and propulsion. Many toy figures also operate in combination with accessories such as simulated weapons, sports equipment, autos and other vehicles as well as accessory-type environments such as buildings or dwellings.

The appearance of toy figures is also subject to substantial variation and thus toy figures have varied in appearance from fanciful cartoon-like figures to highly authentic and carefully designed realistic animal figures. Toy figures have also been provided which are exaggerated in appearance resembling monsters or the like. One popular type of toy figure is known generally in the art as "action figures" and often embodies a super warrior or super soldier type figure. Additionally, mechanical appearing toy figures such as robots or so-called "transformable" toy figures have also proven to be very popular among consumers.

One of the more recent developments in the toy figure art has been the advent of remotely controlled toy figures. Such figures typically employ an internal battery power supply and one or more motors operative to provide articulation and movement, propulsion, and other actions or features. The remote control mechanism itself utilizes a handheld controller with a communication capability to a receiver within the toy figure. Such control links used for remote control have included a tether or wire connection, wireless radio link, infrared communication as well as sound or ultrasound communication.

The continued and increasing popularity of toy figures has resulted in prompting practitioners in the toy arts to provide a virtually endless variety of toy figures. For example, U.S. Pat. No. 5,158,492 issued to Rudell, et al. sets forth a LIGHT ACTIVATED DOLL having a doll supporting movable arms and movable upper torso and head together with a plurality of light sensors and control apparatus. A remote control unit configured to resemble a camera supports a plurality of user inputs and a communicating light source. The light source is used to illuminate the sensors of the doll with command signals to which the doll responds.

U.S. Pat. No. 3,675,92 issued to Ryan, et al. sets forth a COLOR RESPONSIVE TOY which senses the color of a target area to select an appropriate output. One of the toys being a rifle which can be aimed at a target to register whether or not a hit has been made. The rifle includes a lens which focuses light precisely in the direction of aim of the rifle onto two identical photo cells. A red filter is placed in front of the first cell while a neutral density filter is placed in front of the second cell. As a result, the red filtered cell generates a larger output when the rifle is properly aimed at the target.

U.S. Pat. No. 5,741,185 issued to Kwan, et al. sets forth an INTERACTIVE LIGHT-OPERATED TOY SHOOTING GAME having a light projector or light gun and a player-worn target together with self-propelled toy targets all of which detect light emitted by the toy light gun. A shooting game which includes at least one toy light game and at least one toy target is provided in which one game player attempts to "hit" a target with a light gun. The detectors within the target provide audio/visual effects upon being illuminated by a light projecting gun.

U.S. Pat. No. 4,815,733 issued to Yokoi sets forth a PHOTO-SENSING VIDEO GAME CONTROL SYSTEM which operates in combination with a cathode ray tube display. A robot includes a photo-detector facing the screen of the display which detects an image on the screen. The photo-detector of the robot generates a code signal corresponding to a change in image brightness or the like.

U.S. Pat. No. 5,127,658 issued to Openiano sets forth a REMOTELY-CONTROLLED LIGHT-BEAM FIRING AND SENSING VEHICULAR TOY operative to emit a light beam in simulated gun fire. The toy vehicle is sensitive to the directionally emitted light beams or simulated gun fire of other vehicles. Such sensitivity is normally sequentially periodic in quadrants circumferentially around the vehicle to provide an element of randomness and timing for the registration of simulated hits.

In a related type of toy figure, U.S. Pat. No. 5,158,493 issued to Morgrey sets forth a REMOTE CONTROLLED, MULTI-LEGGED, WALKING ROBOT having a skeletal frame supported by right and left leg/foot assemblies and a skeletal structure interconnecting the right and left leg/foot assemblies with freedom for movement.

U.S. Pat. No. 5,142,803 issued to Lang sets forth an ANIMATED CHARACTER SYSTEM WITH REAL-TIME CONTROL utilizing radio frequency communication for audio, video and other control signals to animate the character and provide speech. A camera supported within the head of the animated character together with microphones also supported therein are used to provide vision and hearing for the character. A speaker is located within the animal character to provide sound for the operator.

U.S. Pat. No. 4,623,317 issued to Nagano sets forth a METAMORPHIC RADIO-CONTROLLED TRAVELING TOY includes a traveling element together with a plurality of articulated robot elements such as torso, arms, leg, head and so on. The robot elements are multiply articulated to facilitate the alternate configuration of the toy figure into a vehicle utilizing a common traveling element for propulsion.

In a still further related art area, U.S. Pat. No. 4,571,201 issued to Matsuda sets forth a TOY GUN CONVERTIBLE INTO ROBOTIC-HUMANOID FORM in which a toy gun is fabricated of an assembly of articulated sub-components. The sub-components may be alternately arranged through their articulated joints to be reconfigured into a robot-like creature.

U.S. Pat. No. 4,575,352 and U.S. Pat. No. 4,583,958 both issued to Matsuda set forth similar toy guns reconfigurable into robot-like forms.

U.S. Pat. No. 5,261,852 issued to Ejima sets forth a SHOOTING DEVICE FOR TOY capable of providing interest in pleasure and exhibiting reality. The shooting device includes a body which is provided with a shooting mechanism for forward launch of bullets together with a magazine for storing bullets. The bullets are fed from the bullet storage magazine to the shooting mechanism by gravity action with each stroke of the shooting mechanism.

U.S. Pat. No. 5,299,971 issued to Hart sets forth an INTERACTIVE TRACKING DEVICE having a base supporting a rotatable mount upon which a device such as a camera may be supported. A stepping motor and control system is operative within the base to rotate the camera supporting platform in response to tracking sensors. The sensors respond to the output of tracking devices placed upon the to-be-photographed or imaged target.

While the foregoing described prior art devices have to some extent improved the art and have in some instances enjoyed commercial success, there remains nonetheless a continuing need in the art for evermore improved, interesting and amusing toy figures.

SUMMARY OF THE INVENTION

Accordingly, it is a general object of the present invention to provide an improved and more amusing toy figure. It is a more particular object of the present invention to provide an improved and more amusing toy figure which is operative in response to remote control provided by the toy user.

In accordance with the present invention, there is provided a toy figure comprising: a toy figure body; a weapons pack supported by the body; a remote control receiver and controller supported by the body; a plurality of projectile launchers each pivotally supported upon the weapons pack and each having a spring-driven launcher mechanism and a trigger element and each projectile launcher moveable between a folded position and a launching position; a plurality of springs coupled to the projectile launchers urging the projectile launchers toward the launching positions; a plurality of releasable latches coupled to the projectile launchers for restraining the projectile launchers in the folded positions against the forces of the springs; a plurality of projectiles each spring-loaded into one of the projectile launchers; release means, responsive to the remote control receiver and controller, for releasing the latches allowing the projectile launchers to pivot to the launching positions; trigger means, Responsive to the remote control receiver and controller, for activating the trigger elements to launch the projectiles; and a remote control transmitter having means for producing a command signal directed toward the remote control receiver and controller, the remote control transmitter command signal operative to cause the remote control receiver and controller to activate the release means and the trigger means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 13 sets forth a partial side view of an upper weapons launcher;

FIG. 14 sets forth a partial section view of a typical side mounted weapons launcher of the present invention toy figure;

DESCRIPTION OF THE PREFERRED EMBODIMENT

Figure 1:
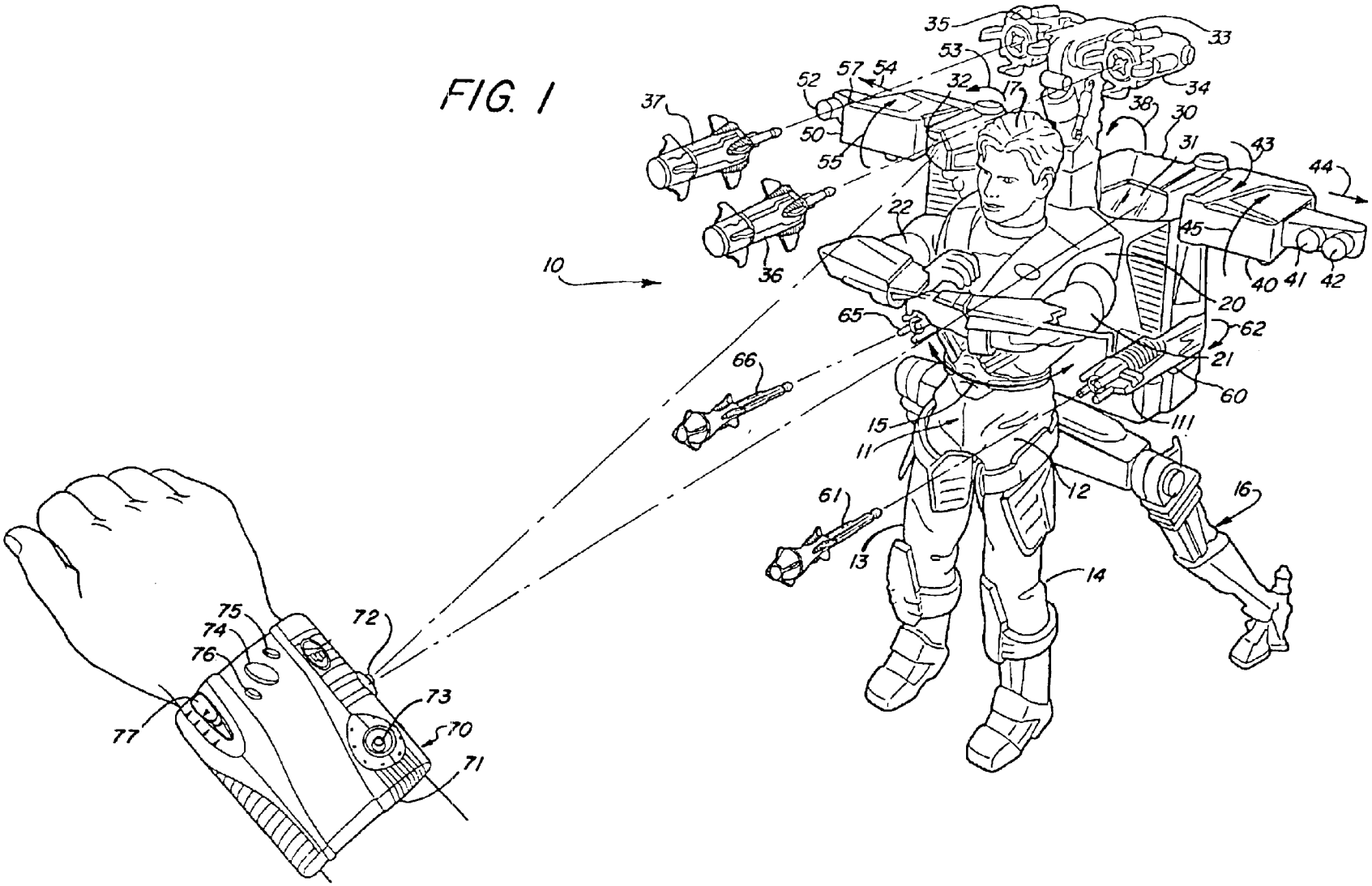
FIG. 1 sets forth a perspective view of the present invention toy figure and its remote controller in a typical operational scenario.

FIG. 1 sets forth a perspective view of a weapon firing toy figure and remote control unit used therewith. A remote control weapon firing toy figure generally referenced by numeral 10 includes a toy figure body 11 having a pair of supporting legs 13 and 14, a lower torso 12 and an upper torso 20 is supported by a supplemental support 16. Upper torso 20 further supports a pair of arms 21 and 22 and a head 17. Upper torso 20 and lower torso 12 are joined in a pivotal motor driven attachment allowing upper torso 20 to move in the directions indicated by arrows 15.

Figure 10:
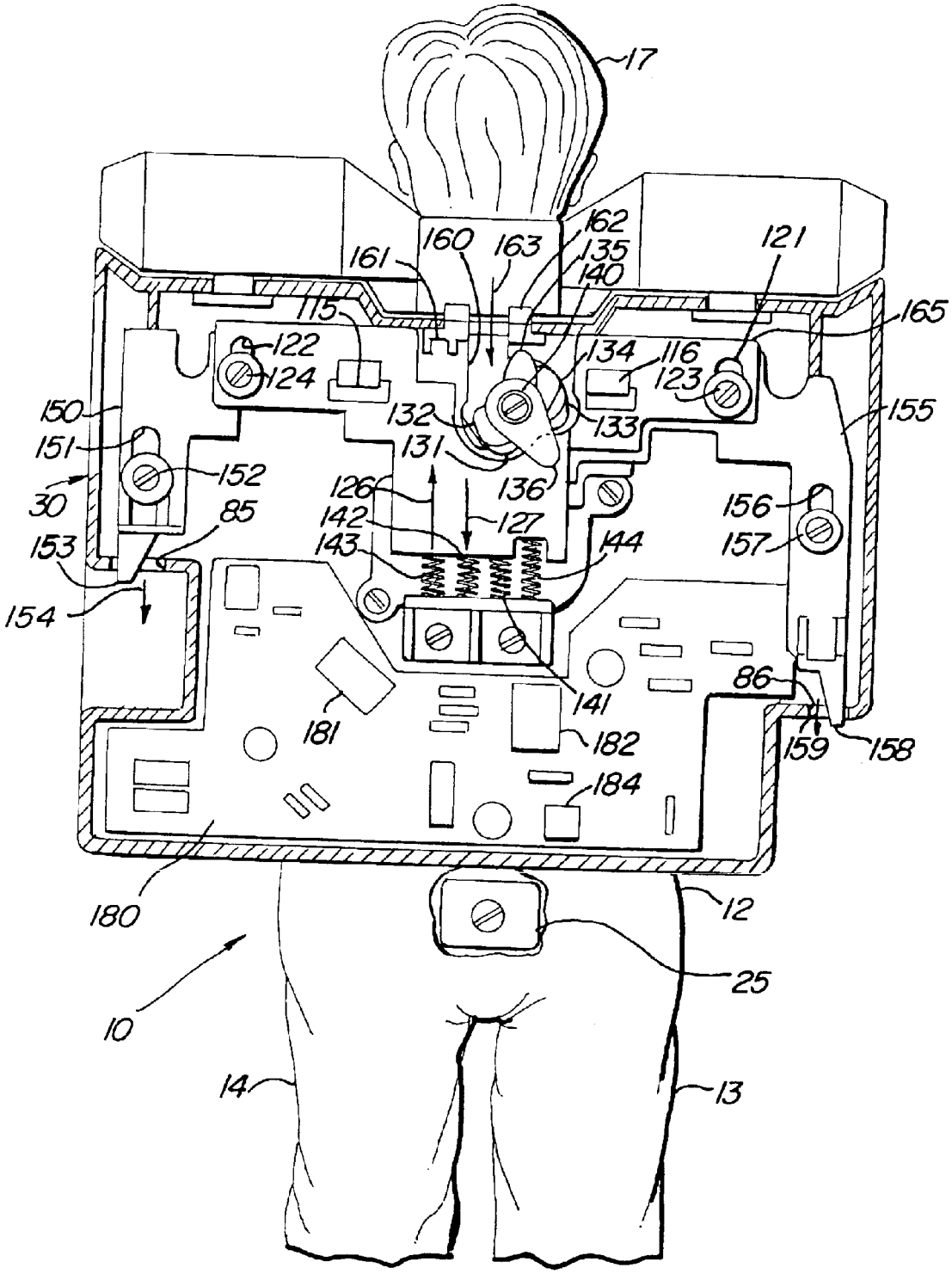
FIG. 10 sets forth a partial section rear view of the present invention toy figure and weapons backpack.

Toy FIG. 10 further includes a weapons backpack generally referenced by numeral 30 joined to and supported by upper torso 12. In the configuration shown in FIG. 1, weapons backpack 30 is configured for weapons firing and, for further illustration, a plurality of projectiles are shown in their mid-flight positions having been fired by the weapons carried by weapons backpack 30.

More specifically, weapons backpack 30 includes an upper projectile launcher assembly 33 having a pair of projectile launchers 34 and 35 secured thereto. Launchers 34 and 35 are conventional spring-driven launchers of the type well known in the art. A pair of projectiles 36 and 37 also fabricated in accordance with conventional fabrication techniques are shown having been launched from launchers 34 and 35 respectively.

Figure 6:
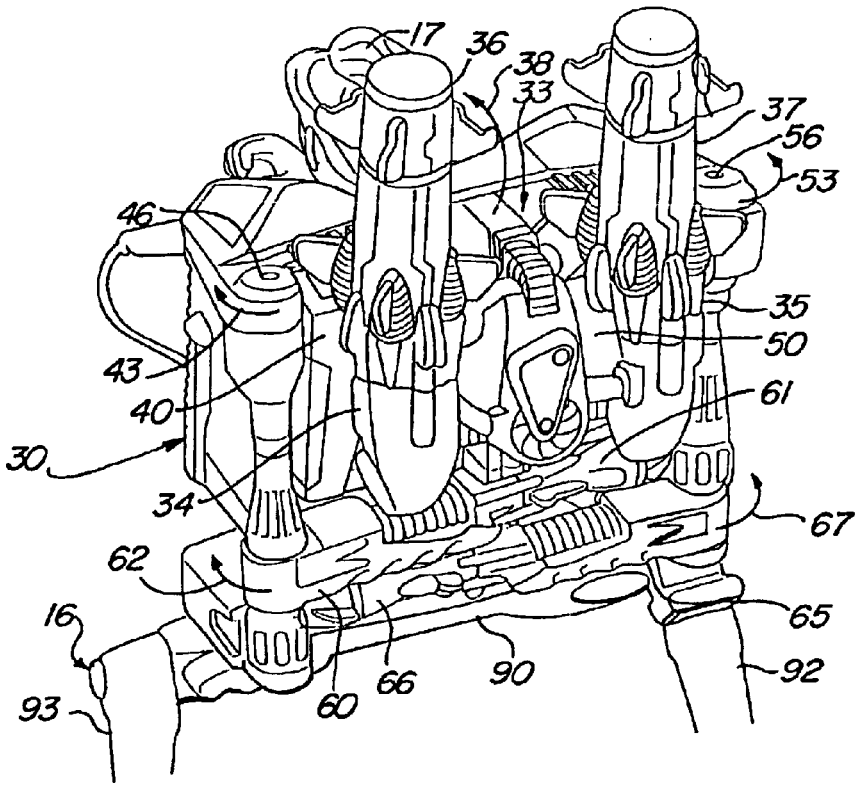
FIG. 6 sets forth a partial rear perspective view of the weapons backpack of the present invention toy figure.

With temporary reference to FIG. 6 for comparison purposes, it will be noted that weapons backpack 30 may be alternately configured in a weapons stored or a weapons folded configuration as shown in FIG. 6. Returning to FIG. 1, it will be apparent that upper launcher assembly 33 has moved to its firing position shown in FIG. 1 by an upward and forward pivotal movement upon weapons backpack 30 in the direction indicated by arrow 38.

Weapons backpack 30 further includes a pair of side weapons pods 40 and 50 each of which includes a plurality of simulated firing weapons 41 and 42 and 51 and 52 respectively. Simulated weapons 41 and 42 are spring-loaded to be stored within side pod 40 and spring outwardly to the firing position shown in FIG. 1 by moving in the direction indicated by arrow 44. In addition, side pod 40 is stored in its closed configuration behind weapons backpack 30 in the manner shown in FIG. 6. Side pod 40 is moved to the weapons firing configuration shown in FIG. 1 by pivotal movement in the direction indicated by arrow 43 together with upward turning movement in the direction indicated by arrow 45.

Similarly, side weapons pod 50 is pivoted from its weapons stored position shown in FIG. 6 to the firing position shown in FIG. 1 by a pivotal movement in the direction indicated by arrow 53 and an upward turning movement in the direction indicated by arrow 55. As mentioned, simulated weapons 51 and 52 move outwardly from side pod 50 in the direction indicated by arrow 54.

Weapons backpack 30 further includes a pair of infrared sensors 31 and 32 supported on each side of head 17 of toy figure body 11. The operation of sensors 31 and 32 is described below in greater detail. However, suffice it to note here that sensors 31 and 32 respond to coded signals of infrared energy transmitted by remote controller 70 (described below).

Weapons backpack 30 further includes a pair of pivotally supported side launchers 60 and 65 on each side of weapons backpack 30. Side launcher 60 is pivotal in the manner indicated by arrow 62 to move from the stored configuration shown in FIG. 6 to the forwardly directed weapons firing position shown in FIG. 1. Once again, side launcher 60 may be constructed in accordance with conventional fabrication techniques providing a spring-loaded projectile launcher. In the position shown in FIG. 1, a projectile 61 also of conventional fabrication is shown having been launched from side launcher 60. Side launcher 65 is identical to side launcher 60 and thus is also pivotable between a forwardly directed firing position as shown in FIG. 1 and a closed configuration shown in FIG. 6. Side launcher 65 is also fabricated entirely in accordance with conventional fabrication techniques and receives a projectile 66 which is launched by a spring launch mechanism also of conventional fabrication. Projectile 66 is shown in FIG. 1 immediately following the launch of the projectile. Supplemental support 16 is removably secured to the rear of lower torso 12 in the manner shown in FIGS. 4 and 5. Suffice it to note here that supplemental support 16 is snap-fitted to lower torso 12 and serves to balance the offset weight of weapons backpack 30.

A remote controller 70, fabricated in accordance with conventional fabrication techniques, includes a source of infrared energy outputted by an infrared transmitter 72. Remote controller 70 is worn upon the user's wrist and includes a housing 71 secured by a wrist band 78 (shown in FIGS. 2 and 3). Remote controller 70 includes an action button 74, a left button 75 and a right button 76. Remote controller 70 further includes a mode select switch 77. While the operation of remote controller 70 is described below in greater detail, suffice it to note here that a conventional infrared coding circuit supported within remote controller 70 responds to activation of buttons 74 through 76 to output a suitably coded infrared signal as transmitter 72. This coded signal is sensed and received by sensors 31 and 32 to form input coded signals which the microprocessor control circuit within FIG. 10 (seen in FIG. 15) responds to activate the toy figure. Mode select switch 77 provides a coded signal output at transmitter 72 which causes toy FIG. 10 to respond in a predetermined mode in response to signals from transmitter 72.

In operation and in the manner described below in greater detail, toy FIG. 10 is initially configured in the closed configuration shown in FIG. 6 in which all weapons are stored in a compact position upon weapons backpack 30. Thereafter, the user selects a mode of operation for toy FIG. 10 which prepares remote controller 70 for activation of the toy figure. For example, in the first mode of operation referred to as the "remote control mode", mode selector switch 77 is moved to its first position. With the selection of the remote control mode, toy FIG. 10 responds to pressing of button 75 by the user to pivot upper torso 20 and weapons backpack 30 to the left side. Conversely, when the user presses right button 76, upper torso 20 and weapons backpack 30 are pivoted to the left side. This provides an "aiming" feature for the weapons launch. The weapons launch process is carried forward in response to the user activating button 74. As button 74 is pressed by the user, the coded signal directed to sensors 31 and 32 causes a sequential unfolding of the various weapons systems supported by weapons backpack 30 followed by a sequential firing of the various projectile launchers. Thus, as the user presses action button 74, the operative system within weapons backpack 30 and upper torso 20 described below in greater detail causes upper launcher assembly 33 to pivot upwardly in the direction indicated by arrow 38 to its launched position. Thereafter, side pods 40 and 50 pivot outwardly in the directions indicated by arrows 43 and 53 respectively and turn upwardly to the horizontal positions shown in FIG. 1 by pivoting in the manner indicated by arrows 45 and 55 respectively. Finally, side launchers 60 and 65 pivot outwardly and forwardly in the direction indicated by arrows 62 and 67 (arrow 67 seen in FIG. 6) to assume their forwardly directed firing positions shown in FIG. 1. In the preferred fabrication of the present invention, the user is able to interrupt the operation of toy FIG. 10 once the entire weapons complement has been moved to launch or firing position. Thereafter, actuating button 74 again produces a sequential launch of projectiles and simulated firing of weapons from toy FIG. 10 and weapons backpack 30. It will be apparent to those skilled in the art from the operative descriptions which follow that a variety of operational sequences of weapon deployment and weapon firing and launch may be utilized without departing from the spirit and scope of the present invention.

Once toy FIG. 10 has completed its weapons deployment movements and weapons firing and projectile launching operations, the user may reconfigure the toy figure back to the loaded and folded position shown in FIG. 6 by essentially reversing the process. For example, projectiles 36 and 37 may be forced back into launchers 34 and 35 against the launch springs therein (seen in FIG. 14). Thereafter, upper launcher assembly 33 supporting projectiles 36 and 37 may be pivoted against its support spring in the opposite direction to arrow 38 to return to its stored position shown in FIG. 6. Similarly, side pods 40 and 50 may be returned to their stored positions by essentially reversing the order of movement shown in weapons deployment. That is to say, simulated machine guns 41 and 42 are forced in the opposite direction to arrow 44 into side pod 40 afterwhich side pod 40 is pivoted downwardly in the opposite direction of arrow 45 and pivoted rearwardly in the opposite direction of arrow 43. As is described below, a latch mechanism secures side pod 40 in its stored position at the rear of weapons backpack 30. Similarly, side pod 50 is stored by forcing simulated machine guns 51 and 52 inwardly to the interior of side pod 50 afterwhich side pod 50 is pivoted downwardly and then rearwardly in the opposite direction to arrows 55 and 53. Once again, side pod 50 is latched by a latch mechanism shown below in FIG. 8 and FIG. 9 to its stored position.

Finally, projectiles 61 and 66 may be reloaded into launchers 60 and 65 afterwhich launchers 60 and 65 are pivoted rearwardly in the opposite direction indicated for arrows 62 and 67 (arrow 67 seen in FIG. 6) to be latched in the stored position of FIG. 6. At this point, toy FIG. 10 and its entire weapon system have again been reconfigured for the above-described weapons deployment and weapons firing operation.

Figure 2:
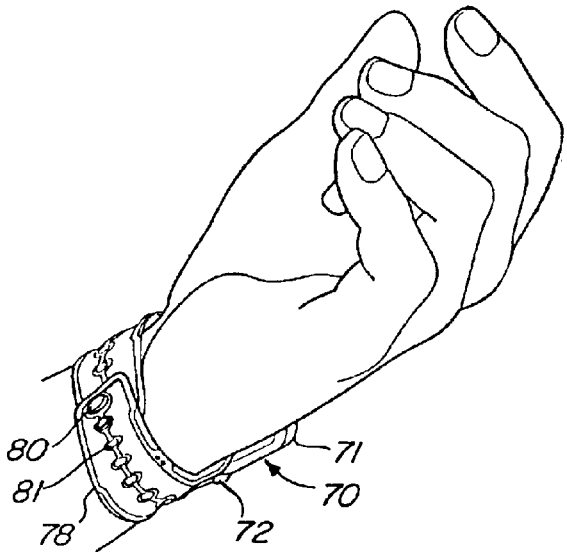
FIG. 2 sets forth a perspective view of the wrist mounted remote controller of the present invention toy figure.

FIG. 2 sets forth a perspective view of remote controller 70 secured to a user's wrist in a typical attachment. This attachment is provided by wrapping a wrist band 78 around the user's wrist and thereafter utilizing a plurality of cooperating apertures 81 and a clasp 80 to secure remote controller 70.

Figure 3:
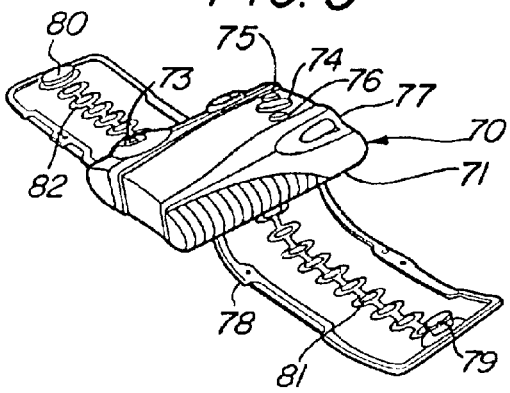
FIG. 3 sets forth a perspective view of the wrist mounted remote controller of the present invention removed from the wearer's wrist.

FIG. 3 sets forth perspective a view of remote controller 70 in its flattened configuration. Controller 70 includes a housing 71 supporting a plurality of buttons 74, 75 and 76 for action, left and right commands. Housing 71 further supports an operational indicator 73 together with a mode select switch 77. A wrist band 78 preferably formed of a flexible plastic or rubber material is secured to housing 71 and defines a plurality of apertures 81 and a clasp 79. Wrist band 78 further includes a plurality of apertures 82 and a cooperating clasp 80. While the means of attachment for wrist band 78 may be varied substantially without departing from the spirit and scope of the present invention, it has been found advantageous to use a simple insertable clasp received within the appropriate one of apertures 81 and 82 to secure wrist band 78 in the manner shown in FIG. 2.

Figure 4:
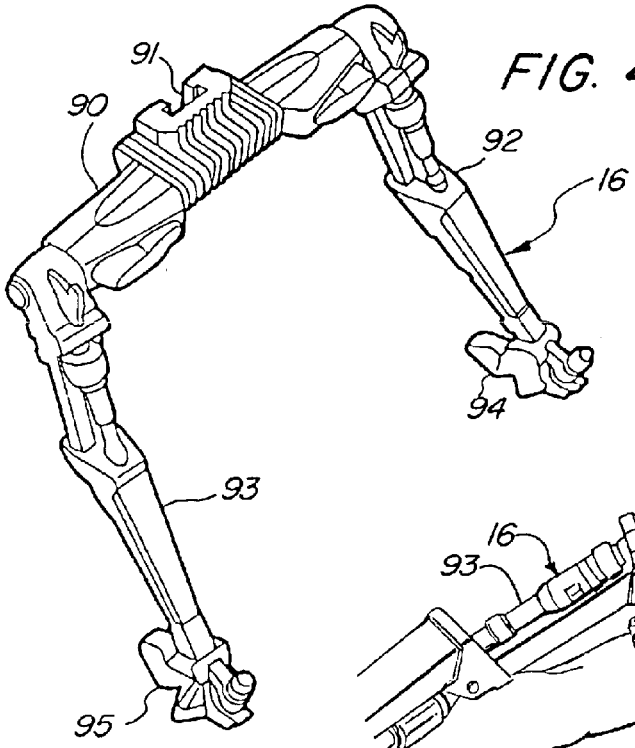
FIG. 4 sets forth a perspective rear view of the supplement support legs of the present invention toy figure.

FIG. 4 sets forth a rear perspective view of supplemental support 16. Support 16 includes a cross member 90 having a snap-fit receptacle 91 formed at the center thereof. Support 16 further includes a pair of downwardly and rearwardly directed legs 92 and 93 supported by feet 94 and 95.

Figure 5:
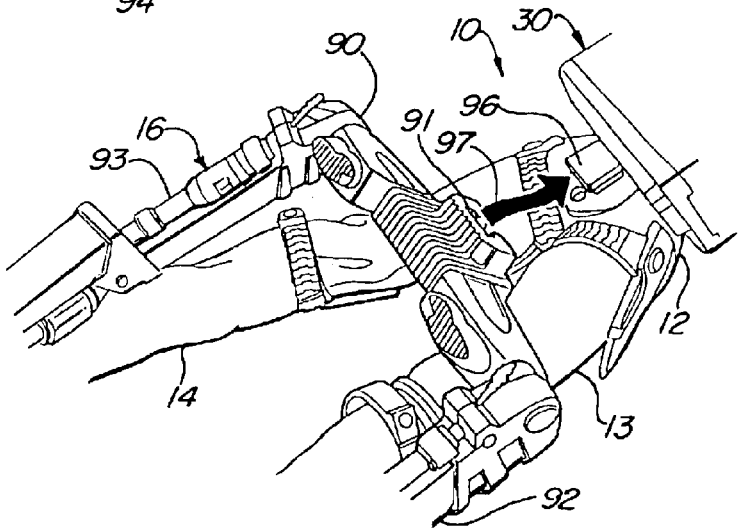
FIG. 5 sets forth a partial perspective assembly rear view showing the attachment of the supplemental support legs to the toy figure of the present invention.

FIG. 5 sets forth a partial perspective view of the assembly of supplemental support 16 to toy FIG. 10. As described above, support 16 includes a cross member 90 defining a receptacle 91 supported by a pair of legs 92 and 93. Correspondingly, toy FIG. 10 supports a weapons backpack 30 and is itself supported by a pair of legs 13 and 14 extending downwardly from lower torso 12. A snap tab 96 is secured to the rear surface of lower torso 12 and is sized and shaped to be received within receptacle 91 in the manner shown by arrow 97. In the preferred fabrication of the present invention, the fit of tab 96 within receptacle 91 is a snug but removably snap-fit allowing supplemental support 16 to be removed from toy FIG. 10 for variation of toy play pattern.

Figure 8:
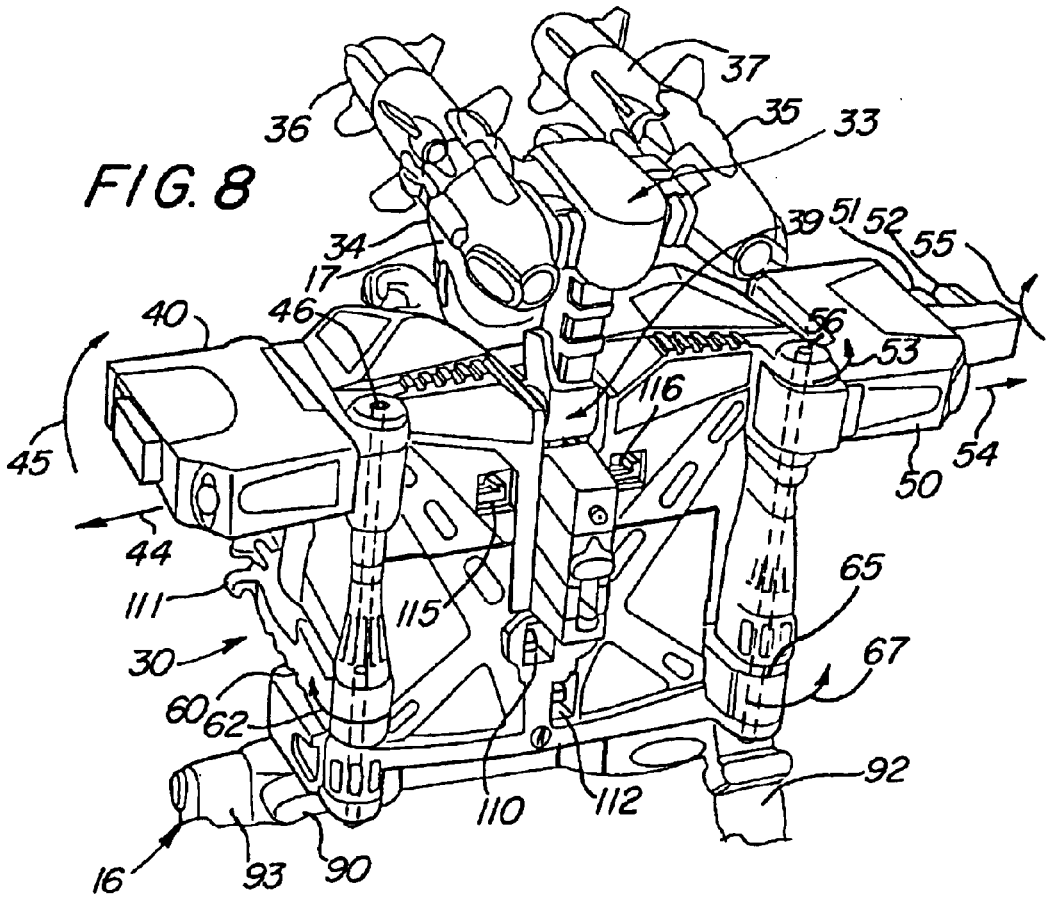
FIG. 8 sets forth a partial perspective rear view of the backpack of the present invention toy figure illustrating the loading of a projectile within its launcher.
Figure 7:
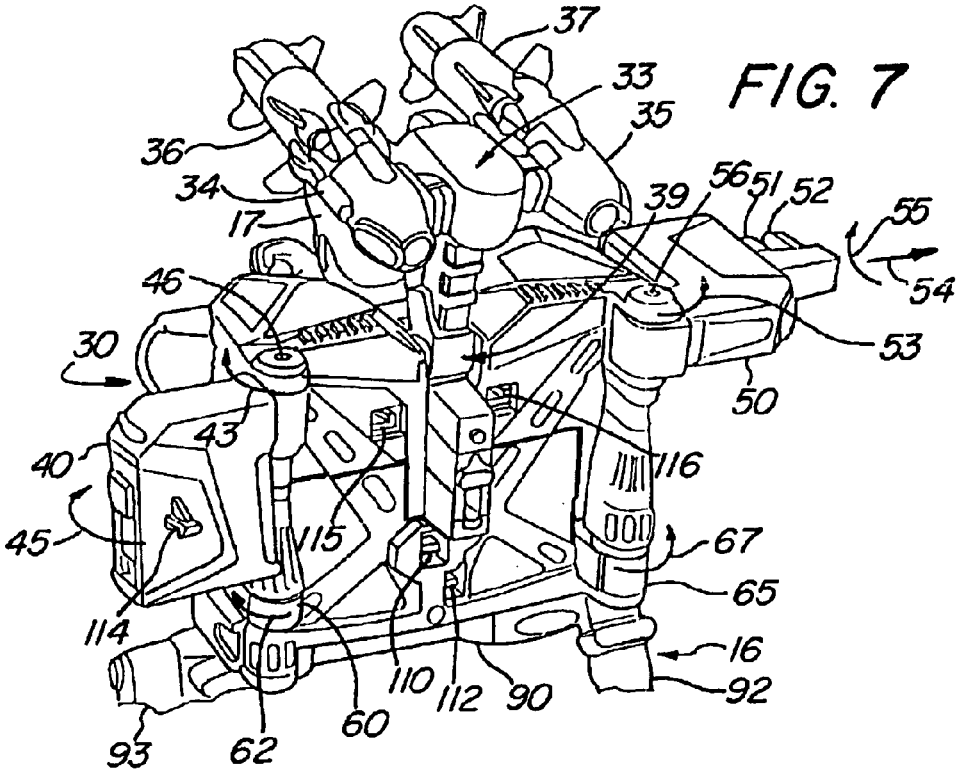
FIG. 7 sets forth a partial rear perspective view of the weapons backpack of the present invention toy figure in a partially retracted configuration.

FIG. 6 sets forth a rear perspective view of weapons backpack 30 supported upon toy FIG. 10 and supplemental support 16. By way of overview, FIG. 6 shows weapons backpack 30 in its fully closed position in which none of the weapons are configured for firing. In contrast, FIGS. 7 and 8 show sequential views of weapons backpack 30 as the various weapons systems are configured for launching and firing. Finally, FIG. 9 sets forth the initial step of reloading and reconfiguring the projectile launchers of backpack 30 to return the weapons backpack to its launch and firing configuration.

More specifically, weapons backpack 30 is supported by toy FIG. 10 having head 17 upon supplemental support 16 having legs 92 and 93 together with a cross piece 90. Weapons backpack 30 supports an upper launcher assembly 33 having launchers 34 and 35 in parallel arrangement. Launchers 34 and 35 support a pair of projectiles 36 and 37 respectively.

Weapons backpack 30 further includes a pair of side pods 40 and 50 each pivotable about a pair of hinges 46 and 56 respectively in the directions indicated by arrows 43 and 53. A pair of side launchers 60 and 65 are pivotally supported upon weapons backpack 30 and are movable in the directions indicated by arrows 62 and 67 respectively. Side launcher 60 supports a projectile 61 while side launcher 65 supports a projectile 66.

Figure 11:
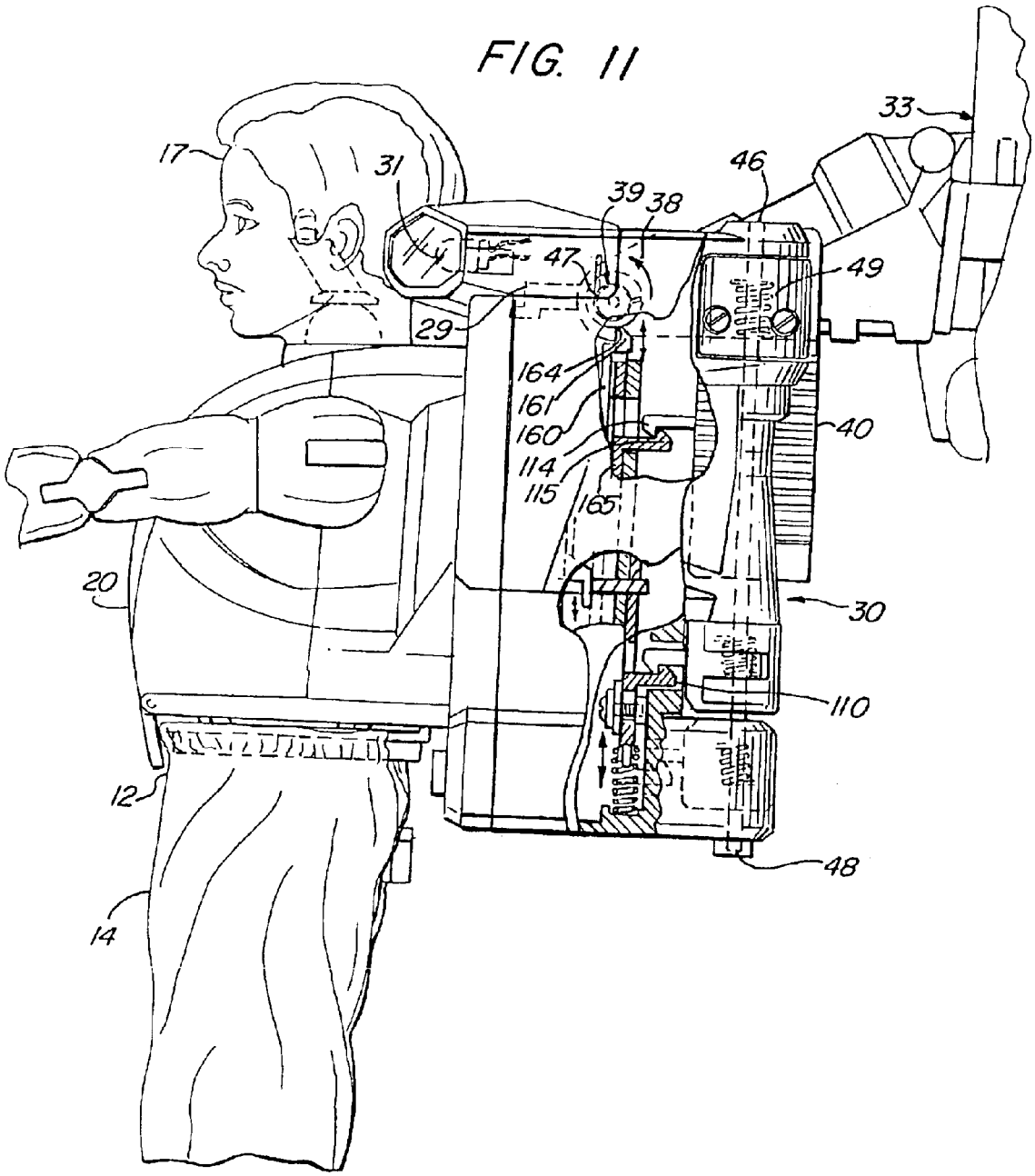
FIG. 11 sets forth a partial section side view of the present invention toy figure and weapons backpack.

In the closed configuration shown, upper launcher assembly 33 is latched in its retracted position against an internal spring in the manner shown in FIG. 11. Suffice it to note here that the internal spring operative upon upper launcher assembly 33 urges launcher assembly 33 upwardly in the direction indicated by arrow 38 to the raised position shown in FIG. 7. Similarly, side pods 40 and 50 are spring-biased by an internal spring mechanism (shown in FIG. 11) and latched in the closed configuration of FIG. 6 by a latch mechanism also shown in FIG. 11. The internal springs operatively coupled to side pods 40 and 50 urge pivotal movement of side pods 40 and 50 outwardly about hinges 46 and 56 in the directions indicated by arrows 43 and 53. Finally, side launchers 60 and 65 are pivoted to the closed position shown in FIG. 6 against an internal spring mechanism and secured by a latch mechanism (both seen in FIG. 11) which maintains side launchers 60 and 65 in the closed configuration shown in FIG. 6. The spring mechanisms operable upon launchers 60 and 65 urge launchers 60 and 65 toward pivotal movement outwardly and forwardly in the directions indicated by arrows 62 and 67 respectively.

Thus, in the closed configuration shown in FIG. 6 and by means set forth below in greater detail, launcher assembly 33, side pods 40 and 50, and side launchers 60 and 65 are all spring-loaded and biased toward their respective firing configurations (seen in FIG. 1) and restrained by releasable latch mechanisms. As a result, the transformation of weapons backpack 30 from the weapons closed or secured configuration shown in FIG. 6 to the firing and launch configuration shown in FIG. 1 is achieved by simply releasing the respective latches restraining the various weapons apparatus and allowing the spring mechanisms coupled thereto to move each weapons system to its launch configuration. In the manner set forth below in greater detail, the release of these various latches is carried forward in response to infrared coded signal from remote controller 70 (seen in FIG. 1).

FIG. 7 sets forth a rear perspective view of weapons backpack 30 as the change from the stored configuration of FIG. 6 to the weapons deployed configuration of FIG. 1 is initiated. By way of overview, FIG. 7 in essence shows weapons backpack 30 immediately following the release of the various restraining latches described below in greater detail which has allowed the weapons systems to move toward their weapons deployed configuration.

More specifically, weapons backpack 30 is supported by toy FIG. 10 having head 17 upon supplemental support 16 having legs 92 and 93 together with a cross piece 90. Weapons backpack 30 supports an upper launcher assembly 33 having launchers 34 and 35 in parallel arrangement. Launchers 34 and 35 support a pair of projectiles 36 and 37 respectively.

Weapons backpack 30 further includes a pair of side pods 40 and 50 each pivotable about a pair of hinges 46 and 56 respectively in the directions indicated by arrows 43 and 53. A pair of side launchers 60 and 65 are pivotally supported upon weapons backpack 30 and are movable in the directions indicated by arrows 62 and 67 respectively. Side launcher 60 supports a projectile 61 while side launcher 65 supports a projectile 66.

In the configuration shown in FIG. 7, upper launcher assembly 33 has moved about a pivot 39 to its raised configuration. Similarly, side launchers 60 and 65 are shown having pivoted outwardly and forwardly to their firing positions in the directions indicated by arrows 62 and 67. Finally, side pod 50 is shown in its launch or firing position having pivoted forwardly in the direction indicated by arrow 53 and turned upwardly in the direction indicated by arrow 55. Similarly, simulated machine guns 51 and 52 have moved outwardly from side pod 50 in the direction indicated by arrow 54. Side pod 40 is shown halfway through its forward deployment to its firing configuration having pivoted forwardly and outwardly in the direction indicated by arrow 43. However, side pod 40 has not yet pivoted upwardly in the direction indicated by arrow 45 to turn side pod 40 to its full firing position.

As mentioned above, side pods 40 and 50 are restrained by latch mechanisms in their closed configurations. These latch mechanisms include a pair of latch elements 115 and 116 supported at the rear of weapons backpack 30 which cooperate with a pair of latches formed on the rear surfaces of side pods 40 and 50. Side pod 40 supports a latch 114 which cooperates with latch 115 to provide the latch mechanism for pod 40. While not seen in FIG. 7, it will be understood that side pod 50 supports an identical latch to latch 14 upon pod 40 which cooperates with latch 116 to provide the securing latch mechanism for restraining pod 50 in its closed position.

Weapons backpack 30 further supports a pair of latches 110 and 112 which cooperate with corresponding latch mechanisms supported upon side launchers 60 and 65. Thus, side launcher 60 supports a latch 111 (seen FIG. 8) which cooperates with latch 110 to restrain launcher 60 in its closed configuration. While not seen in FIG. 7, it will be understood that side launcher 65 supports an identical latch to latch 111 which cooperates with latch 112 to restrain side launcher 65 in its closed configuration.

FIG. 8 sets forth a rear perspective view of weapons backpack 30 in its fully deployed weapons condition which corresponds to the condition shown in FIG. 1.

More specifically, weapons backpack 30 is supported by toy FIG. 10 having head 17 upon supplemental support 16 having legs 92 and 93 together with a cross piece 90. Weapons backpack 30 supports an upper launcher assembly 33 having launchers 34 and 35 in parallel arrangement. Launchers 34 and 35 support a pair of projectiles 36 and 37 respectively.

Weapons backpack 30 further includes a pair of side pods 40 and 50 each pivotable about a pair of hinges 46 and 56 respectively in the directions indicated by arrows 43 and 53. A pair of side launchers 60 and 65 are pivotally supported upon weapons backpack 30 and are movable in the directions indicated by arrows 62 and 67 respectively. Side launcher 60 supports a projectile 61 while side launcher 65 supports a projectile 66.

In the fully deployed configuration shown in FIG. 8, the entire weapons complement of weapons backpack 30 is ready for the weapons firing. For purposes of illustration, however, side pod 40 is shown having its simulated machine guns 41 and 42 (seen in FIG. 1) just prior to their outward movement in the direction indicated by arrow 44. Thus, it will be understood that the full weapons deployment is completed in FIG. 8 once simulated machine guns 41 and 42 move outwardly from side pod 40.

Figure 9:
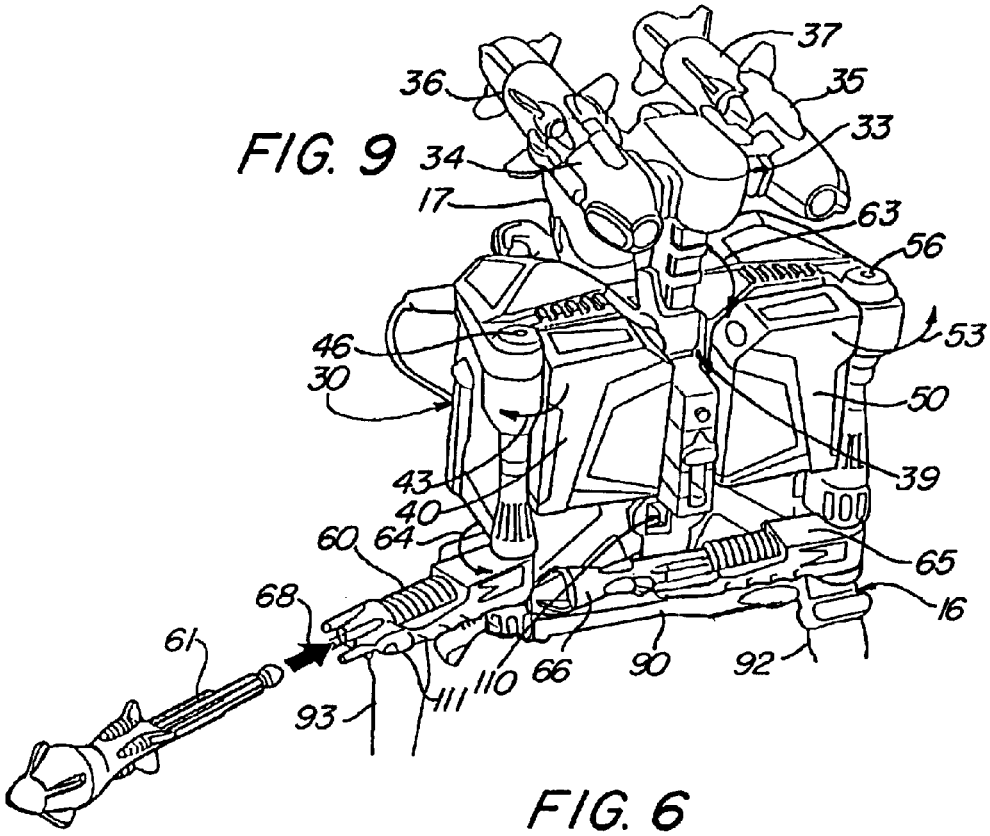
FIG. 9 sets forth a partial rear perspective view of the weapons backpack of the present invention toy figure in its weapons retracted configuration.

FIG. 9 sets forth a rear perspective view of weapons backpack 30 in a partially reconfigured or stored configuration. FIG. 9 also provides illustration of the loading of a typical projectile launcher within the weapons complement.

More specifically, weapons backpack 30 is supported by toy FIG. 10 having head 17 upon supplemental support 16 having legs 92 and 93 together with a cross piece 90. Weapons backpack 30 supports an upper launcher assembly 33 having launchers 34 and 35 in parallel arrangement. Launchers 34 and 35 support a pair of projectiles 36 and 37 respectively.

Weapons backpack 30 further includes a pair of side pods 40 and 50 each pivotable about a pair of hinges 46 and 56 respectively in the directions indicated by arrows 43 and 53. A pair of side launchers 60 and 65 are pivotally supported upon weapons backpack 30 and are movable in the directions indicated by arrows 62 and 67 respectively. Side launcher 60 supports a projectile 61 while side launcher 65 supports a projectile 66.

In the operational configuration shown in FIG. 9, side pods 40 and 50 have been pivoted rearwardly and downwardly to be latched once again in their closed configurations. Similarly, side launcher 65 has been pivoted rearwardly and having projectile 66 loaded therein has been latched in its closed configuration. By way of illustration, side launcher 60 is shown receiving projectile 61 for reloading. Projectile 61 is forced into launcher 60 in the direction indicated by arrow 68. In the manner set forth below in greater detail, projectile 61 is latched against the launch spring mechanism of launcher 60 to complete the loading of projectile launcher 60. Thereafter, launcher 60 is pivoted in the direction indicated by arrow 64 and secured in its closed configuration by the cooperation of latches 110 and 111. Finally, upper launcher assembly 33 having launchers 34 and 35 loaded with projectiles 36 and 37 respectively may be returned to its closed configuration by pivoting launcher assembly 33 downwardly about pivot 39 in the direction indicated by arrow 63. Once again, the latch mechanism operative upon launchers assembly 33 shown in FIG. 11 will secure launcher assembly 33 in its closed configuration. Once weapons backpack 30 has been returned to its closed configuration, the entire backpack assumes the configuration shown in FIG. 6.

FIG. 10 sets forth a partially sectioned rear view of the weapons backpack and present invention toy figure. As described above, toy FIG. 10 includes a lower torso 12 supported by a pair of legs 13 and 14. Toy FIG. 10 further includes a head 17 extending above a weapons backpack 30. Weapons backpack 30 supports a printed circuit board 180 having a plurality digital electronic components supported thereon. Such components form the control circuit shown in FIG. 15 in block diagram form and include a microprocessor 181, a memory 182 and a sound circuit 184 all of conventional fabrication. Weapons backpack 30 further includes a latch plate 150 having a slot 151 defined therein. While not seen in FIG. 10, latch plate 150 further includes an end portion pivotally secured to a pivot post 123. Latch plate 150 further includes a trigger element 153 extending downwardly through an aperture 85 formed in weapons backpack 30. A spring 144 is coupled to latch plate 150 and urges latch plate 150 upwardly in the direction indicated by arrow 127 toward the position shown in FIG. 10. A post 152 is received within slot 151 and cooperates therewith to guide trigger 153 downwardly in the direction indicated by arrow 154 through aperture 85 when latch plate 150 is moved.

Weapons backpack 30 further includes a latch plate 155 defining a slot 156 therein. Latch plate 155 is pivotally secured at its left most end upon a post 124. A post 157 is received within slot 156 and serves to guide the pivoting movement of latch plate 155. A trigger element 158 extends downwardly from latch plate 155 and passes through an aperture 86 formed in weapons backpack 30. A spring 142 is operatively coupled to latch plate 155 and produces a spring force upwardly in the direction indicated by arrow 127 urging latch plate 155 upwardly toward the position shown in FIG. 10. Slot 156 and post 157 cooperate to guide trigger 158 downwardly through aperture 85 in the direction indicated by arrow 159 when latch plate 155 is moved.

Weapons backpack 30 further includes a latch plate 160 moveably supported upon posts 123 and 124. Latch plate 160 includes a pair of latches 161 and 162 extending upwardly therefrom. A spring 143 is operatively coupled to latch plate 160 urging it upwardly in the direction indicated by arrow 127 toward the raised position shown in FIG. 10.

A latch plate 165 defines a pair of elongated slots 121 and 122 which are received upon post 123 and 124 respectively. Latch plate 165 is guided in its vertical movement by slots 121 and 122 upon post 123 and 124. A spring 144 is operatively coupled to latch plate 165 urging it upwardly in the direction indicated by arrow 127 toward the raised position shown in FIG. 10. Latch plate 165 further supports a pair of rearwardly extending latches 115 and 116.

Figure 12:
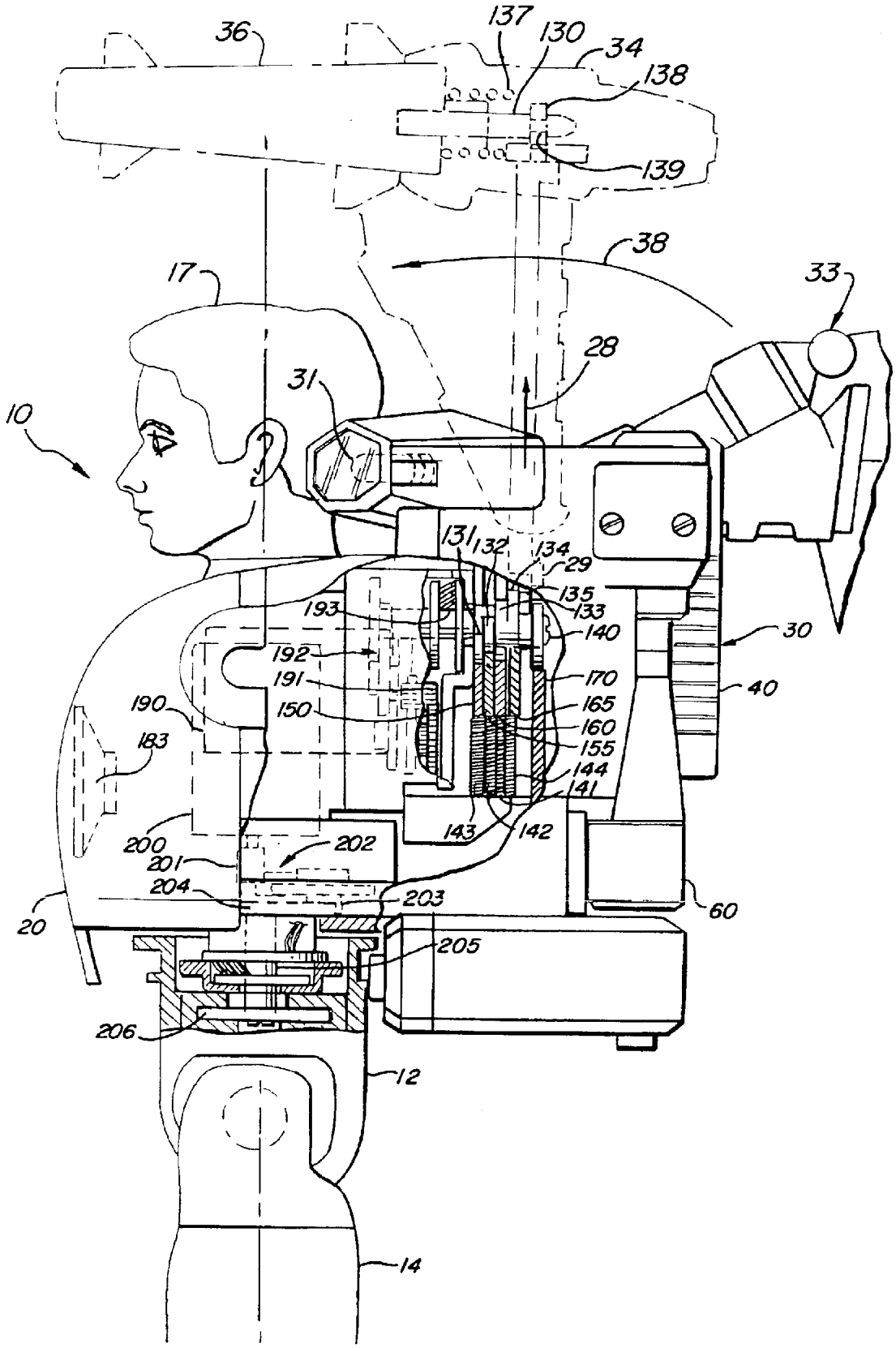
FIG. 12 sets forth a partial section side view of the present invention toy figure and weapons backpack.

A shaft 140 which, as is better seen in FIG. 12, is rotated under motor power supports a plurality of cams 131, 132, 133, 134, 135 and 136. Cams 131 through 136 are sequentially arranged in a rearwardly extending sequence better seen in FIG. 12. However, suffice it to note here that each of cams 131 through 134 are aligned with one of latch plates 150, 155, 160 or 165. More specifically, cam 131 is aligned with latch plate 150 while cam 132 is aligned with latch plate 155. Further, cam 133 is aligned with latch plate 160 while cam 134 is aligned with latch plate 165. Thus, each of cams 131 through 134 cooperates with and provides movement of respective one of latch plates 150, 155, 160 and 165 as shaft 140 is rotated. Additionally, a cam 135 also rotated by shaft 140 operates in the manner shown in FIG. 12 to engage the triggering element (trigger 29) of upper launcher assembly 33 (also seen in FIG. 12) as shaft 140 is rotated. Finally, cam 136 which also is rotated by shaft 140 engages and moves a latch plate 170 (seen in FIG. 12) the operation of which is set forth below in FIG. 11 in greater detail.

In operation, as the motor drive system described below rotates shaft 140 in response to remote control commands provided by the user in the manner shown in FIG. 1, cams 131 through 134 interact with latch plates 150, 155, 160 and 165 to move the latch plates downwardly in the direction indicated by arrow 126 against springs 141, 142, 143 and 144 respectively. The downward movement of each latch plate produces a release of a corresponding weapons latch or alternatively the firing of a particular weapon. Additionally, as cam 136 against latch plate 170 (seen in FIG. 12) additional weapons latches are released. Finally, the rotation of cam 135 triggers the weapons launch of upper launcher assembly 33.

While it will be recognized by those skilled in the art that different sequences of weapons latch release and weapons triggering may be provided by different cam configurations without departing from the spirit and scope of the present invention, the following sequence of cam and latch plate interaction has been found advantageous. Thus, as shaft 140 is rotated, cam 133 initially moves latch plate 160 which releases latches 161 and 162 from restraining upper launcher assembly 133 (seen in FIG. 12) after which cam 134 moves latch plate 165 releasing latches 115 and 116 from restraining side pods 40 and 50 (seen in FIG. 8). Thereafter, cam 136 moves latch plate 170 (seen in FIG. 12) which releases latches 110 and 112 (seen in FIG. 8) which restrain side launchers 60 and 65. At this point, the entire weapons complement of weapons backpack 30 is configured for firing and launch action in the manner seen in FIG. 1.

Continued rotation of shaft 140 then causes cam 135 to engage trigger 29 of upper launch assembly 33 (seen in FIG. 12) to fire projectiles 36 and 37 therefrom (seen in FIG. 8). Finally, further rotation of shaft 140 causes cam 131 to move latch plate 150 triggering the firing of side launcher 60 (seen in FIG. 8) followed by the action of cam 132 against latch plate 155 moving latch plate 155 and triggering the projectile launch of side launcher 65 (seen in FIG. 1). In this manner, the rotation of shaft 140 and the timed action of cams 131 through 136 provide for the properly sequenced deployment of weapons from weapons backpack 30 followed by a sequence of projectile launching therefrom. At this point, the complete cycle of weapons deployment and launching or firing has been completed.

FIG. 11 sets forth a partial section side view of weapons backpack 30 supported upon toy FIG. 10. As described above, toy FIG. 10 includes a lower torso 12 supported by a pair of legs 13 and 14 (leg 13 seen in FIG. 1). Toy FIG. 10 further includes an upper torso 20 which, as described above, is pivotally moveable upon lower torso 12. Upper torso 20 further supports a head 17 and a weapons backpack 30. Weapons backpack 30 includes a pair of sensors 31 and 32 (sensor 32 seen in FIG. 1). Weapons backpack 30 supports an upper launcher assembly 33 which is pivotally supported by a pivot 39 upon backpack 30. A spring 47 is coupled to pivot 39 exerting a spring force against upper launcher assembly 33 in the direction indicated by arrow 38. Pivot 39 further includes a latch 164. A moveable latch plate 160 includes a latch 161 which engages latch 164 to restrain upper launcher assembly 33 against the force of spring 47 in the lowered position shown in FIG. 11.

Weapons backpack 30 further includes a pair of side pods 40 and 50 (side pod 50 seen in FIG. 1). Side pod 40 is pivotally secured to weapons backpack 30 at a hinge 46. An internal spring 49 is operatively coupled to side pod 40 and provides a spring force urging side pod 40 outwardly about hinge 46 in the direction indicated by arrow 43 (seen in FIG. 1). Similarly, while not shown in FIG. 11, it will be understood that side pod 50 is supported by an identical hinge and spring combination upon weapons backpack 30 to provide a spring force urging side pod outwardly in the direction indicated by arrow 53 in FIG. 1. Side pod 40 supports an inwardly extending latch 114 which engages a rearwardly extending latch 115. Latch 115 is supported by a latch plate 165. As is better seen in FIG. 7 together with FIG. 10, latch plate 165 supports a latch 116 which engages a corresponding latch (not shown) supported by side pod 50 which, in an identical manner to the structure of latch 114 of side pod 40 engages latch 116 to restrain side pod 50 in the closed configuration shown in FIG. 6. Latch plate 165 is moveable in the direction indicated by arrows 145.

A latch plate 170 is moveable in the directions indicated by arrows 147 within weapons backpack 30 in the manner described above. Latch plate 170 supports a pair of latches 110 and 112 which extend rearwardly within weapons backpack 30. A side launcher 60 is pivotally secured to weapons backpack 30 and includes a forwardly extending latch 111 which engages latch 110. A spring 148 is coupled to side launcher 60 and provides a spring force in the direction indicated by arrow 62 (seen in FIG. 1) The force of spring 148 is restrained by the cooperation of latches 110 and 111. Similarly, a side launcher 65 is pivotally supported upon weapons backpack 30 and includes a forwardly extending latch 117. Latch 117 engages latch 112. A spring 149 is coupled to side launcher 65 and provides a spring force urging side launcher 65 toward pivotal movement in the direction indicated by arrow 67 in FIG. 6. The force of spring 149 is restrained by the cooperation of latches 117 and 112.

In operation, the above described cam movement and cooperating latch plate interaction operates to sequentially release the various latching combinations at work within weapons backpack 30 and to fire the various weapons. Thus, for example, movement of latch plate 160 disengages latch 161 from latch 164 allowing spring 47 to rapidly pivot upper launcher assembly 33 in the direction indicated by arrow 38 to raise upper launcher assembly 33 as described above. Similarly, the downward movement of latch plate 165 disengages latch 115 from latch 114 allowing spring 49 to pivot side pod 40 in the direction indicated by arrow 43. While not seen in FIG. 11, it will be understood that a similar latch release simultaneously occurs upon the latch restraining side pod 50 allowing side pod 50 to pivot outwardly in the direction indicated by arrow 53 (seen in FIG. 1). In addition, the downward movement of latch plate 170 disengages latch 110 from latch 111 and simultaneously disengages latch 112 from latch 117 thereby allowing springs 148 and 149 to rapidly pivot side launchers 60 and 65 outwardly in the directions indicated by arrows 62 and 67 (seen in FIG. 6).

Latch plate 150 supports a downwardly extending trigger 153 extending toward side launcher 60 when side launcher 60 is in the weapons firing configuration shown in FIG. 1. Similarly, and with temporary reference to FIG. 10, it will be noted that latch plate 155 supports downwardly extending trigger 158 which, with simultaneous reference to FIG. 1, will be seen to be positioned above side launcher 65 in a similar manner when side launcher 65 is in its forwardly extending launch position. In the manner set forth below, the downward movement of triggers 153 and 158 (seen in FIG. 10) are operative to trigger the launch of projectiles 61 and 66 respectively from side launchers 60 and 65 during the above described latch plate movements.

FIG. 12 sets forth a partially sectioned side view of the present invention toy figure and weapons backpack 30. As described above, toy FIG. 10 includes a lower torso 12 supported by legs 13 and 14 (leg 13 seen in FIG. 1). As is also described above, toy FIG. 10 includes an upper torso 20 supporting a head 17 and a weapons backpack 30 all of which is pivotable upon lower torso 12.

Weapons backpack 30 supports an upper launcher assembly 33 which is pivotable in the direction indicated by arrow 38 to the raised launching position shown in dash-line representation in FIG. 12. In the raised dash-line position shown in FIG. 12, upper launcher assembly 33 includes a projectile launcher 34 supporting a to-be-launched projectile 36. Projectile 36 is identical to projectile 37 which in turn is supported within launcher 35 both of which are shown in FIG. 1. Thus, the description set forth in FIG. 12 relating to launcher 34 and projectile 36 will be understood to apply equally well to launcher 35 and projectile 37 (seen in FIG. 1). Projectile 36 is conventional in fabrication and includes an elongated rod 130 defining a groove 139 therein. Within launcher 34, a clasp 138 receives rod 130 and engages groove 139. A spring 137 also supported within launcher 34 is compressed as rod 130 is inserted into its engagement with clasp 138. Clasp 138 is supported by an elongated trigger rod 29 such that movement of trigger rod 29 upwardly in the direction indicated by arrow 28 releases the engagement of clasp 138 and allows spring 137 to launch projectile 36. Thus, in the raised position shown in dash-line in FIG. 12 and with projectile 36 loaded into launcher 34, projectile 36 is ready for launch.

Weapons backpack 30 further includes a weapons motor 190 having an output gear 191 rotated thereby. A plurality of gears forming a gear drive unit 192 is operatively coupled to output gear 191 and is further coupled to a rotatable shaft 140. Shaft 140 is rotatably supported by a plurality of bearings such as bearing 193 formed within weapons backpack 30. Shaft 140 further supports a plurality of cams 131, 132, 133, 134, 135 and 136. Cams 136 are also shown in FIG. 10 and are rotatable by rotation of shaft 140. A plurality of latch plates 150, 155, 160 and 165 are slidably supported within weapons backpack 30 in the manner shown in FIG. 10 and are operatively coupled to cams 131 through 134 respectively. Cam 135 is operatively coupled to trigger 29 of upper launcher assembly 33 when upper launcher assembly 33 is in the raised position shown in dash-line in FIG. 12. Finally, cam 136 is operatively coupled to a latch plate 170 which is slidably supported within weapons backpack 30 in the manner shown in FIG. 11. A plurality of springs 143, 142, 141 and 144 are operatively coupled to latch plates 150, 155, 160 and 165 respectively to urge latch plates 150, 155, 160 and 165 against cams 131 through 134 respectively. Similarly, latch plate 170 is supported by a spring 172 (seen in FIG. 11) which urges latch plate 170 against cam 136. Thus, energizing of weapons motor 190 rotates shaft 140 and cams 131 through 136 to provide movement of latch plates 150, 155, 160, 165 and 170 together with trigger unit 29 of upper launcher assembly 33.

Lower torso 12 supports an attachment plate 206 which in turn supports a vertically extending post 205 having a static gear 204 secured to the upper end thereof. Upper torso 20 supports a torso motor 200 having an output gear 201 which is operatively coupled to a gear 203 by a gear drive unit 202. Gear 203 engages static gear 204. Torso motor 200 is a bi-directional gear and is controlled by a motor control shown in FIG. 15. Thus, rotation of torso motor 200 in either direction produces EL corresponding rotation of gear 203 which engages static gear 204. As a result, rotation of gear 203 causes upper torso 20 to pivot upon lower torso 12. This provides the above described operation illustrated by arrows 15 in FIG. 1. A speaker 183 is also supported within upper torso 20 and responds to an internal sound circuit 184 shown in FIG. 10.

Figure 15:
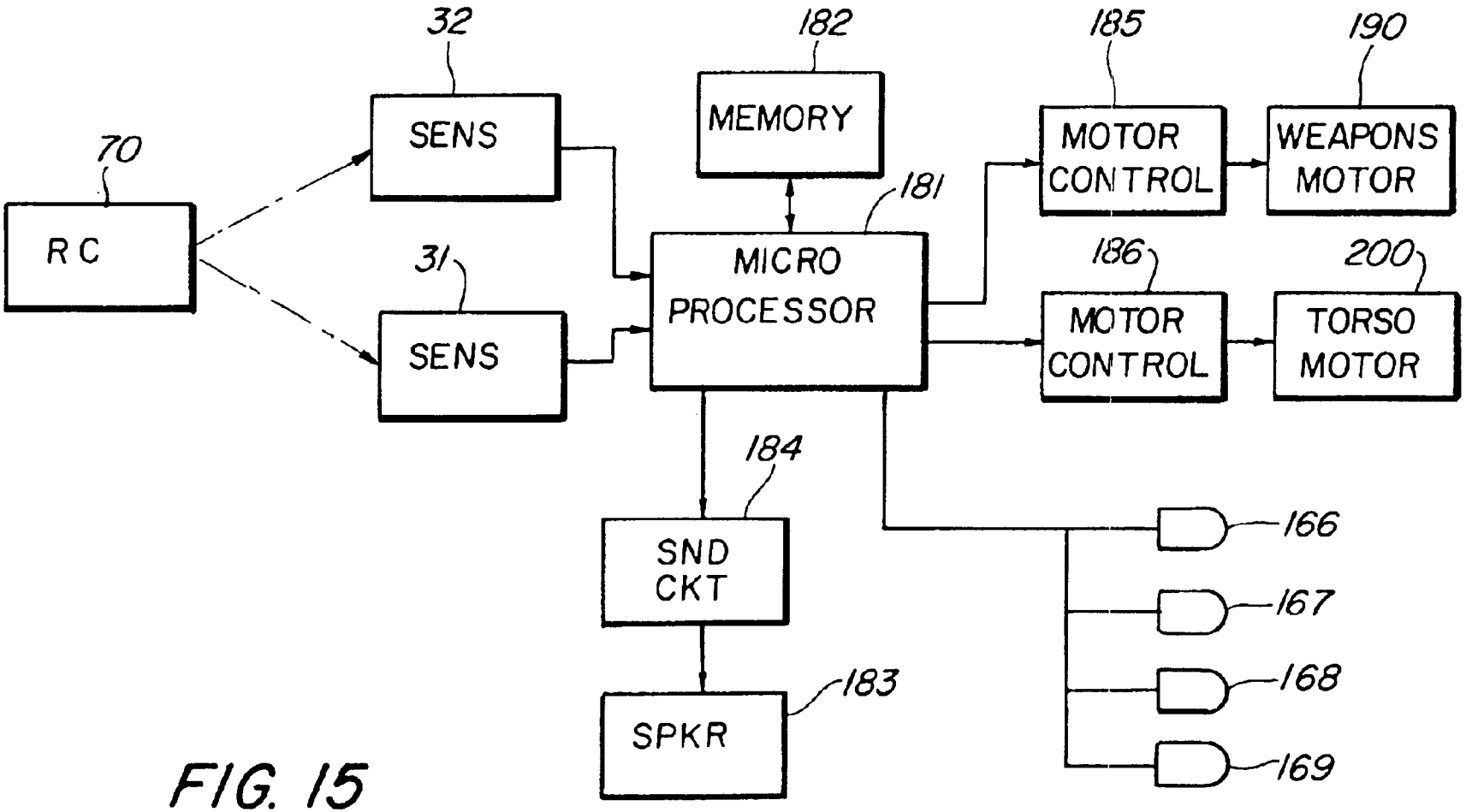
FIG. 15 sets forth a block diagram of the control apparatus of the present invention toy figure.

FIG. 13 sets forth a partial top view of side pod 40 in its extended position upon weapons backpack 30. As described above, side pod 40 supports a pair of simulated machine guns 41 and 42. Simulated 41 and 42 are supported by a spring 179 which urges simulated machine guns 41 and 42 outwardly in the direction indicated by arrow 44. Hinge 46 pivotally supports pod 40 upon weapons backpack 30 and includes a spring 49 which urges pod 40 toward pivotal movement in the direction indicated by arrow 43. Hinge 46 further includes a hinge rod 175 which pivotally supports pod 40 and which further supports a spring 176. Spring 176 is coupled to pod 40 and urges pod 40 upwardly in the direction indicated by arrow 45 (seen in FIG. 1). Simulated machine guns 41 and 42 are preferably formed of a tinted light transmissive material such as transparent red plastic or the like. Simulated machine guns 41 and 42 support a pair of light emitting diodes 166 and 167 respectively. As is better seen in FIG. 15, light emitting diodes 166 and 167 are operatively coupled to microprocessor 181. While not seen in FIG. 13, it will be understood by those skilled in the art that side pod 50 (seen in FIG. 1) is identical to side pod 40 and is operative in precisely the same manner. Accordingly, a second pair of light emitting diodes 168 and 169 are shown in FIG. 15 operatively coupled to microprocessor 181. Light emitting diodes 168 and 169 are the corresponding light emitting diodes within pod 50.

FIG. 14 shows a partially sectioned top view of side launcher 60 having projectile 61 loaded therein. More specifically, side launcher 60 is supported upon weapons backpack 30 by a hinge 199 having a spring 148 coupled thereto. Spring 148 urges launcher 60 toward rotational movement in the direction indicated by arrow 62. Launcher 60 further includes a latch 111 and a release button 198. Release button 198 supports a downwardly extending clasp 197. Launcher 60 further includes a launch spring 194. Projectile 61 includes a rod 195 having a groove 196 formed therein. Projectile 61 is loaded into launcher 60 by forcing rod 195 against spring 194 until groove 196 is engaged by clasp 197. Projectile 61 is launched by a downward pressure upon trigger pad 198. It will be understood by those skilled in the art that the structure and apparatus set forth in FIG. 14 of side launcher 60 applies equally well and is equally descriptive of side launcher 65 (seen in FIG. 1). Accordingly, side launcher 65 receives projectile 66 (seen in FIG. 1) in the identical manner as shown for projectile 61 within launcher 60.

With temporary return to FIG. 10, it will be noted that latch plate 150 supports a trigger element 153 while latch plate 155 supports a trigger element 158. When side launchers 60 and 65 are configured in their forwardly directed launch positions shown in FIG. 1, trigger elements 153 and 158 are positioned directly above the trigger pads (such as pad 198 of launcher 60). Thus, downward movement of trigger elements 153 and 158 (seen in FIG. 10) provide launch of projectiles 61 and 66 respectively.

FIG. 15 sets forth a block diagram of the control circuitry within the present invention toy figure. A microprocessor 181 includes and associated memory 182 both of which may be fabricated in accordance with conventional fabrication techniques. Memory 182 includes a stored set of instructions which define the operation of microprocessor 181 in accordance with the three modes of operation selectable for the present invention toy figure. Microprocessor 181 is operatively coupled to a motor control 185 which in turn is coupled to a weapons motor 190. Similarly, microprocessor 181 is operatively coupled to a motor control 186 which in turn is operatively coupled to a torso motor 200. A plurality of light emitting diodes 166, 167, 168 and 169 are further coupled to microprocessor 181. A sound circuit 184 and a speaker 183 both of which are fabricated in accordance with conventional fabrication techniques, is operatively coupled to microprocessor 181. A pair of infrared sensors 31 and 32 are coupled to respective inputs of microprocessor 181. A remote control unit 70 is in command communication with sensors 31 and 32 in the manner described above in FIG. 1 by the transmission of coded infrared signals.

In operation, remote control 70 initially selects a mode of operation prior to transmitting commands in the manner set forth above in FIG. 1. In its first mode of operation identified as the "remote control mode", commands transmitted from remote controller 70 in the manner described in FIG. 1 are received by sensor 31 or 32 are utilized in activating torso motor 200 to provide pivotal movement of the upper torso and weapons backpack of the present invention toy figure to either the left or right. Additionally, in the manner also described above, remote control unit 70 may transmit coded instructions which are utilized by processor 181 to activate weapons motor 190 to provide the above described sequence of weapons configurations and simulated operation. This operation as described above, requires nothing beyond the activation of weapons motor 190 to provide sequential cam movement and latch plate movement (described above) to initiate weapons configuration and firing. Additionally, microprocessor 181 also activates light emitting diodes 166 through 169 selectively and repeatedly when simulated machine gun fire is to be initiated. Microprocessor 181 also produces sound signals applicable to sound circuit 184 which are converted to audio signals capable of energizing speaker 183.

When the mode selection switch of remote control 70 is placed in the second mode of operation referred to as "tracking", microprocessor 181 utilizes sensor 31 and 32 in a differential measurement to determine the position and movement of remote control unit 70. In response to differential commands and the software instructions stored within memory 182, microprocessor 181 activates motor control 186 appropriately to energize torso motor 200 in the appropriate direction to cause the toy figure upper torso and weapons backpack to "follow" the movement of remote control unit 70.

In the third mode of operation referred to as the "sentry" mode of operation, the light energy detected by sensors 31 and 32 is utilized to determine an increase of ambient light. In response to an increase of ambient light, microprocessor 181 under the stored instructions within memory 182 energizes motor control 185 so as to operate motor 190 to complete a full cycle of weapons deployment and launch.

What has been shown is a toy figure operable under infrared remote control which responds to command signals from the remote control unit worn by the user to provide an exciting and entertaining sequence of weapons array and deployment as well as an amusing and entertaining sequence of weapons firing and launching. The entire operation of weapons deployment and launching or firing is carried forward in response to a single infrared command from the remote control unit.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a toy figure body;

a weapons pack supported by said body;

a remote control receiver and controller supported by said body;

a plurality of projectile launchers each pivotally supported upon said weapons pack and each having a spring-driven launcher mechanism and a trigger element and each projectile launcher moveable between a folded position and a launching position;

a plurality of springs coupled to said projectile launchers urging said projectile launchers toward said launching positions;

a plurality of releasable latches coupled to said projectile launchers for restraining said projectile launchers in said folded positions against the forces of said springs;

a plurality of projectiles each spring-loaded into one of said projectile launchers;

release means, responsive to said remote control receiver and controller, for releasing said latches allowing said projectile launchers to pivot to said launching positions;

trigger means, responsive to said remote control receiver and controller, for activating said trigger elements to launch said projectiles; and a remote control transmitter having means for producing a command signal directed toward said remote control receiver and controller, said remote control transmitter command signal operative to cause said remote control receiver and controller to activate said release means and said trigger means.

2. The toy figure set forth in claim 1 wherein said toy figure body includes a lower torso and an upper torso pivotably supported thereon and means for pivoting said upper torso.

3. The toy figure set forth in claim 2 further including torso pivoting means, responsive to said remote control receiver and controller, for pivoting said upper torso and wherein said remote control transmitter includes means for producing a command signal operative to cause said remote control receiver and controller to activate said torso pivoting means.

4. The toy figure set forth in claim 3 wherein said remote control transmitter includes an action button for activating said release means and said trigger means.

5. The toy figure set forth in claim 4 wherein said remote control transmitter includes a left button and a right button for activating said torso pivoting means to cause it to pivot said upper torso in either direction.

6. A toy figure comprising;

a toy figure body having supporting legs, a torso and an associated weapons backpack;

a first pair of projectile launchers pivotably supported by said weapons backpack moveable between a forwardly directed launch position and a folded position, said first pair of projectile launchers having a first pair of springs urging said first pair of projectile launchers toward said launching positions and a first pair of latches restraining said first pair of projectile launchers in said folded positions;

a first pair of projectiles constructed to be launched by said first pair of projectile launchers;

a remote control receiver and controller operative in response to a remote control command signal to release said first pair of latches and to trigger the launch of said first pair of projectiles from said first pair of projectile launchers; and a remote control transmitter for producing a remote control command signal.

7. The toy figure set forth in claim 6 further including:

an upper launcher assembly pivotably supported by said weapons backpack between a launching position and a retracted position, having a second pair of projectile launchers, a spring surging said upper launcher assembly toward said launching position and an upper launcher assembly latch restraining said upper launcher assembly in said retracted position; and a second pair of projectiles constructed to be launched from said second pair of projectile launchers, said remote control receiver and controller being operative in response to a remote control command signal to release said upper launcher assembly and to trigger the launch of said second pair of projectiles.

* * * * *